United States Patent [19]

Ceribelli

[11] 3,998,147

[45] Dec. 21, 1976

[54] DEVICE FOR WIRE-BINDING BALES OF INCOHERENT MATERIAL, SUCH AS STRAW, HAY, ETC. AND FEEDING APPARATUS FOR SUCH A DEVICE

[76] Inventor: Giorgio Ceribelli, Via Privata Pienza, 18, Milan, Italy, 20142

[22] Filed: Nov. 12, 1974

[21] Appl. No.: 523,374

[30] Foreign Application Priority Data

Nov. 16, 1973 Italy ..... 31481/73
Sept. 4, 1974 Italy ..... 26922/74

[52] U.S. Cl. ..... 100/11; 100/31
[51] Int. Cl.[2] ..... B65B 13/28
[58] Field of Search ..... 100/31, 3, 7, 8, 11, 100/17, 18, 29

[56] References Cited

UNITED STATES PATENTS

| | | | |
|---|---|---|---|
| 1,889,372 | 11/1932 | Nolan | 100/31 X |
| 2,610,573 | 9/1952 | Altgelt | 100/31 X |
| 3,667,377 | 6/1972 | Persson | 100/31 |
| 3,789,751 | 2/1974 | Burford | 100/31 |

*Primary Examiner*—Billy J. Wilhite
*Attorney, Agent, or Firm*—Lane, Aitken, Dunner & Ziems

[57] ABSTRACT

A device for wire binding bales of incoherent material or any packs or packages, comprising supply means for the binding wire at locations spaced apart from one another at the level of the outer surface of the package to be bound, wire knotting means arranged on a plane transverse of the package feeding, said knotting means comprising essentially at least two wire guiding means movable to and away from each other on the transverse plane to converge the binding wires to a single location of the transverse plane, said wire guiding means having a central pin or core substantially lying on said transverse plane and which is arranged between the joined or connected wires, and means for causing said pin or core to rotate in order to interlace said binding wires.

12 Claims, 11 Drawing Figures

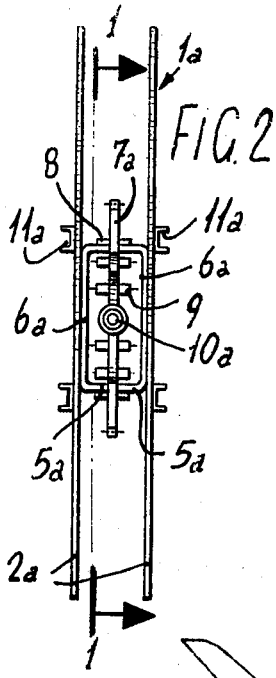
FIG. 2
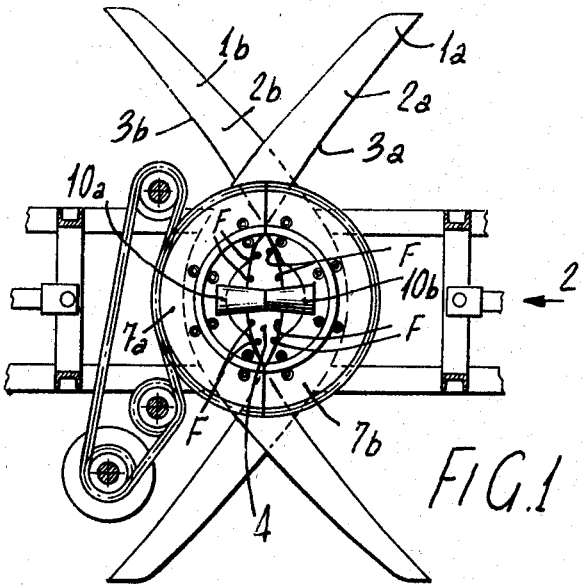
FIG. 1
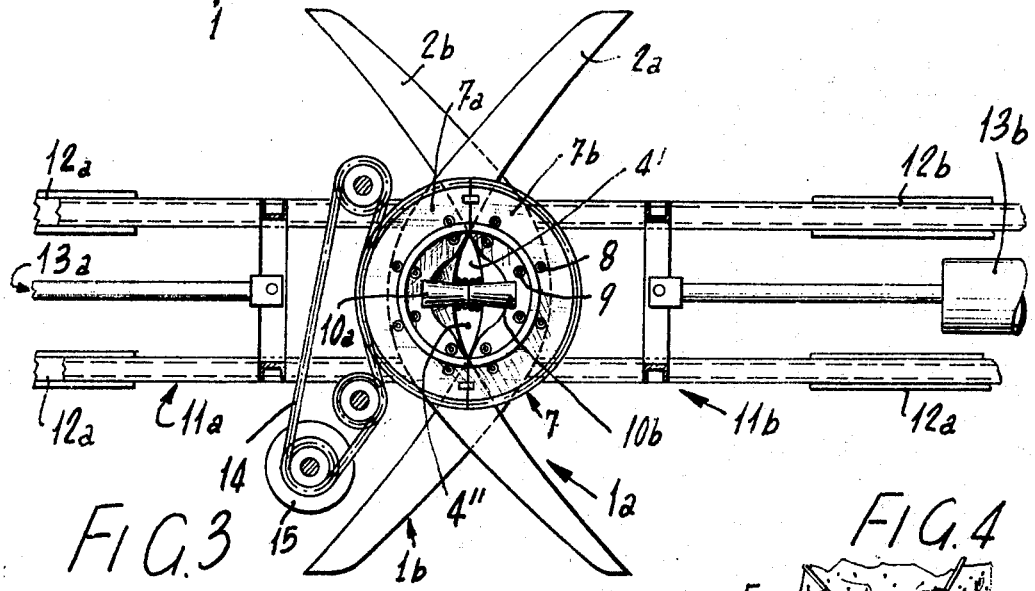
FIG. 3
FIG. 4
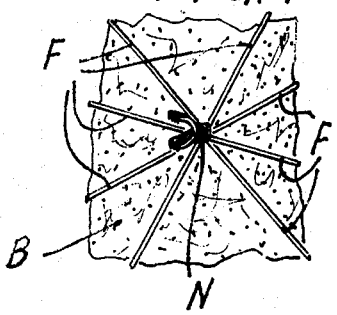

DEVICE FOR WIRE-BINDING BALES OF INCOHERENT MATERIAL, SUCH AS STRAW, HAY, ETC. AND FEEDING APPARATUS FOR SUCH A DEVICE

This invention is concerned with the art of binding packings or packages, or bales of paper, hay, straw and any kind of incoherent materials. For example, it is known to form bales and then bind the same by means of a string or wire. While for string-binding several mechanical apparatus have been designed capable of wrapping up the bales and then providing for knotting, wire-binding which is under some circumstances preferable with respect to string-binding is up to now manually carried out, with high time consuming and labour.

It is the object of the present invention to provide a device for wire-binding articles, such as bales or preformed packages, and more particularly a device for interconnecting and wrapping up the ends of the binding wire by fixing the same together. Such a device substantially comprises two arcuate wire guiding means, which are movable relative to each other and form a central core which can be rotated.

According to the invention, stock to be formed in bales, or a packing or made up package, is moved forward with its leading edge against a knot formed by the binding of a preceding bale or package, and therefrom the wires branch off from the knot to the wire delivery and feed supplies. On advancing, the stock or package will forwardly move said already formed knot and draw the wires unwindng from the feed supplies and arranging thereon according to a substantially longitudinal pattern. When the bale or package arrives with its trailing end at the knotting position or station, the two arcuate means, moving in a convergent direction on a plane transverse of the forward movement of the articled to be bound, will cause the wires to be connected on either side of the transverse core, carried by said arcuate means, which is therefore rotated on itself on said transverse plane, to wrap up the wires in two "knots", of which one upstream and the other downstream of the core, respectively forming the rear knot for the leading article and the front knot for the trailing article. Upon removal of the core and arcuate means, the two knots so formed can be separated from each other by any desired means, such as manually or by cutting means carried by the core, and the cycle is repeated from the beginning to bind a new bale or package.

An embodiment of the binding device according to the present invention will now be described, by mere way of example.

In the accompanying drawings:

FIG. 1 is a sectional view substantially taken along line 1—1 of FIG. 2, and showing part of the binding device at closed position;

FIG. 2 is a side view showing one of the arcuate guide means of the device, such as in the direction of arrow 2 in FIG. 1;

FIG. 3 is a view similar to FIG. 1, but with the binding wires arranged on the core after wrapping operation;

FIG. 4 shows a knot or wrap on the end of a bale or pack, such as obtained through the subject device;

Figure 11:
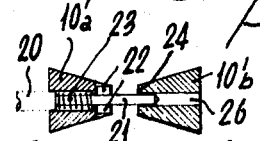
Figure 9:
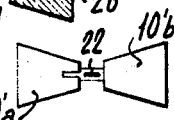
Figure 10:
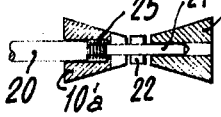

FIGS. 5 and 6 and FIGS. 7 and 8 are schematic side (FIG. 5), top (FIG. 6) and front (FIGS. 7 and 8) views, respectively, several respective positions for the device and bales or packs to be bound at various operation steps;

FIG. 9 is a view showing a cutting device at the position for cutting;

FIG. 10 is a longitudinal sectional view taken along the device shown in FIG. 9;

FIG. 11 is a sectional view similar to FIG. 10, but showing the cutting blades at retracted position;

It should be noted that such terms as "top", "bottom", "upward", "downward", "right" and "left" and the like are herein used only by reference to the embodiment of the device and apparatus shown in the drawings, and not in a limiting sense.

The device, although being shown in the drawings as horizontally arranged, could be as well vertically or otherwise arranged.

As it will be seen with reference to FIGS. 1, 2 and 3, a binding device according to the invention comprises two arcuate elements 1*a* and 1*b*, the elements facing each other and being movable relative to each other as explained in the following.

Each of the elements 1*a* or 1*b* comprise two plates 2*a* for the element 1*a* and 2*b* for the element 2*b*, respectively, substantially parallel arranged and spaced apart from one another by a spacing which is different for the element 1*a* and the element 1*b*, for example as shown in the drawings, so that the plates 2*a* can be accomodated between the plates 2*b*. Each of the plates 2*a* or 2*b* are as high as, or somewhat higher than the bale to be formed and bound and have a concave side 3*a* or 3*b* facing the opposite plate. This concave side accomplishes the function of taking up the binding wires, causing the latter to converge to a central area 4, defined between the two arcuate elements, and therefore each of the sides 3*a* or 3*b* will have a profile designed to this purpose. The overall height of the plates 2*a*, 2*b* is equal to or larger than that of the bale to be bound.

A half-ring 5*a* or 5*b* is made fast (FIG. 2) with each of the plates 2*a* or 2*b* at a position extending to the other plate 2*b* (or 2*a*) and therefore to the corresponding half-ring on that plate. In the embodiment shown in the drawings, each of the half-rings form part of a box portion 6 (6*a* or 6*b*) attached to each of the plates.

A half-gear wheel 7*a* and 7*b*, respectively, is carried between the two half-rings of each pair of plates 2*a* or 2*b*; when connected, the two halves forming the external toothing wheel 7. At each side, this wheel 7 carries on two concentric circumferences two sets of rollers 8 and 9 extending along the axis of the wheel for engaging the half-rings 5*a* and 5*b* on the inner side thereof (rollers 9) and on the outer side thereof (rollers 8). Therefore, said half-rings operate as support and guide means for the roller sliding movement, that is for rotating the two half-wheels about the common center.

The two half-wheels 7*a* and 7*b* define a free space there-between, at least partly corresponding to said central area 4 as formed between the arcuate elements. Each of the half-gear wheels 7*a* or 7*b* carry a preferably frusto-conical spoke 10*a*, 10*b* extending within said free space, these spokes being arranged to coaxially join at the closed position for said two half-wheels to form a single pin. To this end, provision can be made on one of the two spokes for a male element suitable to connect with a female element provided on the other spoke (FIGS. 1 and 3). When connected, said spokes 10*a* and 10*b* divide the opening or free area 4 into a top area 4′ and a bottom area 4″.

Each of the arcuate elements 1*a* or 1*b* are carried on a frame 11*a* or 11*b*, which are slidable, for example, within guide sleeves 12*a* and 12*b* and are driven, for example, by a piston system 13*a* and 13*b* only partially shown.

The above mentioned gear wheel 7 is rotably driven by any desired system, such as a gear drive or, as shown in FIG. 3, by a continuous chain 14 engaging on the toothing thereof, and driven by a pinion controlled by a motor 15.

The operation of the device will be described with particular reference to FIGS. 5, 6, 7 and 8, bearing in mind that the operation sequence is as follows: FIGS. 7, 8, 5 and 6.

Figure 5:
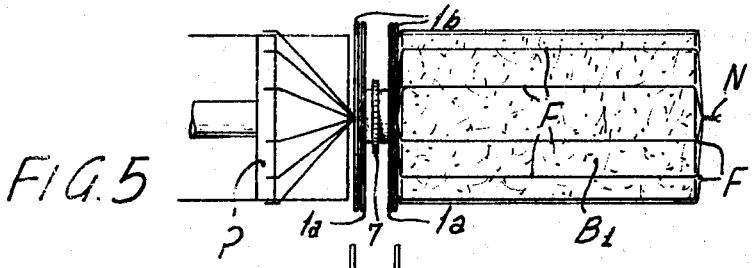
Figure 6:
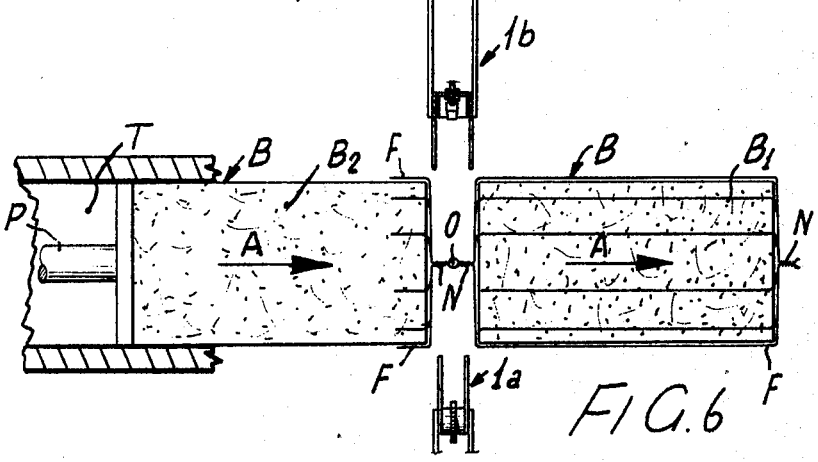
Figure 7:
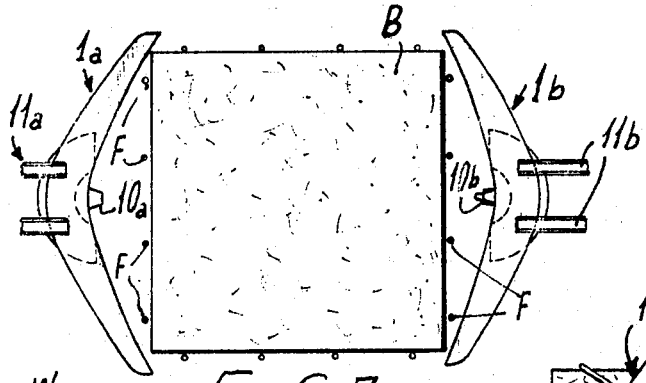
Figure 8:
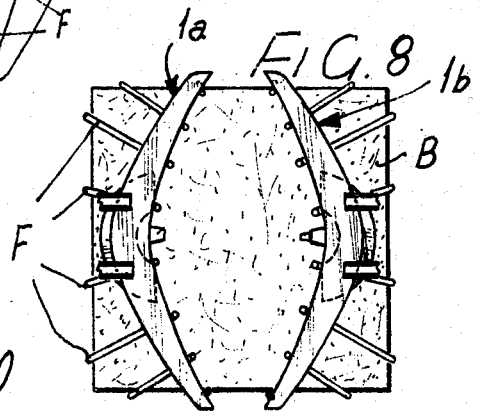

The material to be formed in a bale, such as pieces of paper, hay and the like (or in the case of a preformed pack, the pack itself), is forwardly moved along a tunnel T according to the arrows A by any desired system, for example by a piston P. On one hand, the binding wires F are interlaced in a knot N, formed by a preceding binding operation, in front of the leading edge of the bale that will be formed, and on the other hand said wires F come from supply or delivery means placed in the walls of the tunnel, or outside of it, such as wire rolls, from each of which the wire is unwound passing through a hole in the tunnel wall. In this operation step, (see FIG. 7), the binding devices 1*a* and 1*b*, lying on a plane substantially transverse of the feeding direction, are moved away from the path of the forming bale, which on forwardly moving, will unwind the wires F wrapping it up. When the bale arrives at the position taken by the bale $B_1$, as shown in FIG. 6, the elements 1*a* and 1*b* will move close to each other (FIG. 8). In this movement, each of the elements 1*a* and 1*b* will through their concave surfaces take up and converge in correspondence to an axial central length the binding wires which, upon completion of the approaching movement of said elements 1*a* and 1*b*, will be partly arranged over the former pin 10, and partly beneath thereto (FIG. 1). The two half-gear wheels 7*a* and 7*b* are now caused to rotate through a few revolutions, these half-gear wheels contacting and forming the single wheel 7. Due to this movement, the pin 10 is also rotated around its own axis (which is also the longitudnal central axis of the gear wheel), winding wires F around one another and twisting them upstream and downstream of core or spoke 10. Upon completion of the desired amount of revolutions, and when the two half-wheels have been brought back to such positions as to move the elements 1*a* and 1*b* away from each other, these elements will accordingly be moved away and back to the rest or inoperative position thereof clear of the bale path, which pin can be readily removed from the eyelet O formed between the wires. Of course, said wires would maintain the winding or wrapping attitude as imparted thereto, and are cut within the eyelet O to separate the formed bale. The knot N, as obtained on a bale B, is as shown in FIG. 4.

The cut operation of the eyelet O can be manually carried out, or by any desired means. Particularly, provision was made for the device shown in FIGS. 9, 10, and 11 and described in the following.

In this case, the spokes 10*a* and 10*b* are replaced by the spokes 10'*a* and 10'*b*, which are internally provided with axial through openings; the opening 25 in one of the spokes, such as spoke 10'*a*, accomodates a sliding plunger 20 extending in a rod 21 projecting from the drilled spoke 10'*a*. Said rod 21 carries two radial blades 22, the cutting edge of which faces the spoke 10'*b*. A spring 23 is effective between a shoulder in the opening of the spoke 10'*a* and the head of said plunger 20. The spoke 10'*b* has a surface 24 for cutting co-action with said blades 22, and an axial opening 26 for accomodating said rod 21.

At the rest or inoperative position of the cutting device, that is when the elements 1*a* and 1*b* are moved away from each other, or are approaching, said spring 23 urges said plunger 20, holding the blades 22 within the suitable housings in the spoke 10'*a*. When the elements 1*a* and 1*b* are at their closest position, said rod 21 is partly engaged within the opening 26, and partly free within the space between the spokes 10'*a* and 10'*b* (FIG. 11). The gear wheel 7 is now rotated, as above mentioned, and the wires are twisted or interlaced on the free portion of the rod 21, thus forming an eyelet. When the wheel 7, by any desired means, such as by a cylinder and piston device, the plunger 20 is urged against the force of the spring 23, thus urging the blades 22 against the surface 24 (FIGS. 9 and 10) to cut the wire eyelet. After cutting, the device is brought back to the position as shown in FIG. 11 and the elements 1*a* and 1*b* can be moved away from each other.

As apparent, while remaining valid the peculiar features characterizing the present invention, any constructive variation relating to improvements to the component members without altering the function thereof and objects, would of course be within the covering scope of the present invention.

I claim:

1. A device for binding materials together, comprising wire supply means for supplying a plurality of strands of binding wire, baling means for forming a bale from said materials by extending the strands of binding wire from a front end of a predetermined quantity of said materials to a back end of said materials in a spaced apart relationship around the outer surface of said materials, wire guiding means including two portions movable to and from each other in a plane transverse to said strands of wire, for engaging said wires at said back end and converging said wires at two points along their length, central core defining means associated with said wire guiding means for defining a central core substantially lying in said transverse plane and between said two points and rotating means for rotating said core to interlace said wires on both sides of said core.

2. The device in claim 1, wherein the baling means includes means for moving said materials relative to said wires and in a direction away from said wire supply means.

3. A device as set forth in claim 1 wherein said wire guiding means comprises two pairs of substantially parallel arcuate plates, the plates of each pair being located on one side of said wires and spaced apart from each other a different distance than those of the other pair in order to permit overlapping of the blades of the respective pairs.

4. A device as set forth in claim 3 wherein said rotating means comprises a half gear wheel associated with each said wire guiding means, said half gear wheels adapted to form a single complete gear wheel rotable about its own center relative to the plates and having an open central area through which said core passes.

5. A device as set forth in claim 4 wherein said core is formed of two coaxial spokes, each of which is carried by one of said half-gear wheels.

6. A device as set forth in claim 5 further comprising cutting means for cutting the interlaced wires between said two points to form two separate knots.

7. A device as set forth in claim 6 wherein said cutting means comprises sliding means accommodated within an axial opening in one of said spokes and at least one blade carried by said sliding means, said sliding means being movable between an inoperative position in which said blade is retracted, and a cutting position in which the blade is moved against an opposite surface of said other spoke to shear said wires.

8. A device as set forth in claim 7 further comprising resilient means for urging said sliding means to said inoperative position and control means for urging said sliding means to said cutting position.

9. A device as set forth in claim 4 wherein each of said half-gear wheels is provided with two concentric sets of rollers at each side, and further comprising guide means on each of said plates for guiding said rollers.

10. A device as set forth in claim 4 further comprising a pinion meshing with said gear wheel, and means for controlling said pinion.

11. A device as set forth in claim 4 further comprising a continuous chain for driving said gear wheel.

12. A device as set forth in claim 1 further comprising a frame for carrying each of said wire guiding means, and a cylinder and piston system for moving said frame in said transverse plane.

* * * * *

UNITED STATES PATENT OFFICE

CERTIFICATE OF CORRECTION

Patent No. 3,998,147 Dated December 21, 1976

Inventor(s) GIORGIO CERIBELLI

It is certified that error appears in the above-identified patent and that said Letters Patent are hereby corrected as shown below:

Column 1, line 30, "unwindng" should read -- unwinding --.

Column 1, lines 35 and 36, "articled" should read -- article --.

Column 2, line 20, "comprise" should read -- comprises --.

Column 2, line 44, after "2b" cancel ";" and substitute -- , --.

Column 4, claim 4, line 59, after "each" insert -- of --.

Signed and Sealed this ninth Day of August 1977

[SEAL]

Attest:

RUTH C. MASON
*Attesting Officer*

C. MARSHALL DANN
*Commissioner of Patents and Trademarks*